US009828662B2

(12) United States Patent
Li et al.

(10) Patent No.: US 9,828,662 B2
(45) Date of Patent: Nov. 28, 2017

(54) LOW COST AND HIGH STRENGTH TITANIUM ALLOY AND HEAT TREATMENT PROCESS

(71) Applicant: BEIJING UNIVERSITY OF TECHNOLOGY, Beijing (CN)

(72) Inventors: Bolong Li, Beijing (CN); Tong Liu, Beijing (CN); Wei Wang, Beijing (CN); Hui Huang, Beijing (CN); Hongmei Li, Beijing (CN); Li Rong, Beijing (CN)

(73) Assignee: Beijing University of Technology, Beijing (CN)

( * ) Notice: Subject to any disclaimer, the term of this patent is extended or adjusted under 35 U.S.C. 154(b) by 78 days.

(21) Appl. No.: 13/979,713

(22) PCT Filed: Mar. 28, 2013

(86) PCT No.: PCT/CN2013/073322
§ 371 (c)(1),
(2) Date: Jul. 15, 2013

(87) PCT Pub. No.: WO2014/040408
PCT Pub. Date: Mar. 20, 2014

(65) Prior Publication Data

US 2015/0184272 A1 Jul. 2, 2015

(30) Foreign Application Priority Data

Sep. 14, 2012 (CN) ..... 2012 1 0343128

(51) Int. Cl.
*C22F 1/18* (2006.01)
*C22C 14/00* (2006.01)
*C22F 1/00* (2006.01)

(52) U.S. Cl.
CPC ..... *C22F 1/183* (2013.01); *C22C 14/00* (2013.01); *C22F 1/00* (2013.01); *C22F 1/002* (2013.01); *C22F 1/18* (2013.01)

(58) Field of Classification Search
CPC .... C22C 14/00; C22F 1/00; C22F 1/18; C22F 1/002; C22F 1/183
See application file for complete search history.

(56) References Cited

U.S. PATENT DOCUMENTS 2,575,962 A * 11/1951 Jaffee ..... C22C 14/00 420/418
2,754,204 A * 7/1956 Jaffee ..... C22C 14/00 148/407

(Continued)

FOREIGN PATENT DOCUMENTS

CN 1271024 A * 10/2000
CN 1508272 A 6/2004

(Continued)

OTHER PUBLICATIONS

Matthew J. Donachie, Jr., Titanium, A Technical Guide, Second Ed., ASM International, 2000, Ch. 4, pp. 25-32.*

(Continued)

*Primary Examiner* — Scott Kastler
*Assistant Examiner* — Vanessa T Luk
(74) *Attorney, Agent, or Firm* — Knobbe, Martens, Olson & Bear LLP

(57) ABSTRACT

Systems and methods of a low cost, high strength titanium alloy are disclosed. According to illustrative implementations, the weight percent of the alloy composition may be: Fe content 3%~7%, Al content 3%~5%, C content 0.01%~0.02%, with the balance being Ti and unavoidable impurities. Industrial pure iron, carbon steel, and industrial pure aluminum etc. may be used as the raw materials. In one exemplary method, the raw materials are mixed before being (Continued)

A room temperature tensile stress-strain curve of the Ti-3Fe-5Al-0.01C alloy bar after the 940 °C/40min/WQ+500 °C/4h/AC heat treatment pressed to a block. The block may be double-melted to an alloy cast ingot, forged by a conventional titanium alloy forging process, and subsequently undergo a solid solution treatment of (820° C.~950° C.)/1 h+water quenching, and an ageing treatment of (450° C.~550° C.)/4 h+air cooling, wherein the mechanical properties of the alloy are that σb=1000~1250 MPa, δ=5%-12%.

20 Claims, 2 Drawing Sheets

(56) References Cited

U.S. PATENT DOCUMENTS

| | | | | | |
|---|---|---|---|---|---|
| 2,804,409 | A * | 8/1957 | Kessler | C22F 1/183 | 148/405 |
| 2,867,534 | A * | 1/1959 | Jaffee | C22C 14/00 | 420/418 |
| 3,147,115 | A * | 9/1964 | Vordahl | C22C 14/00 | 148/405 |
| 2008/0071347 | A1 * | 3/2008 | Cambronne | A61L 31/022 | 623/1.15 |

FOREIGN PATENT DOCUMENTS

| | | | | | |
|---|---|---|---|---|---|
| CN | 1962913 | A | | 5/2007 | |
| CN | 101456102 | A | * | 6/2009 | |
| CN | 101463436 | A | | 6/2009 | |
| CN | 101899590 | A | | 12/2010 | |
| CN | 102400013 | A | | 4/2012 | |
| CN | 102482735 | A | | 5/2012 | |
| JP | 2001-115221 | A | | 4/2001 | |
| JP | 2009270163 | A | | 11/2009 | |
| WO | WO 2011049465 | A1 | * | 4/2011 | B21C 23/002 |

OTHER PUBLICATIONS

G.W. Kuhlman, Forging of Titanium Alloys, Metalworking: Bulk Forming, vol. 14A, ASM Handbook, ASM International, 2005, pp. 331-353 (print), pp. 1-9 (online).*

Leonard E. Samuels, Light Microscopy of Carbon Steels, Ch. 4 (partial), Low-Carbon Irons and Steels, ASM International, 1999, pp. 39-59.*

International Search Report in related PCT Application No. PCT/CN2013/073322, (WO2014/040408) dated Sep. 14, 2012, and English language translation of same, 5 pgs.

* cited by examiner

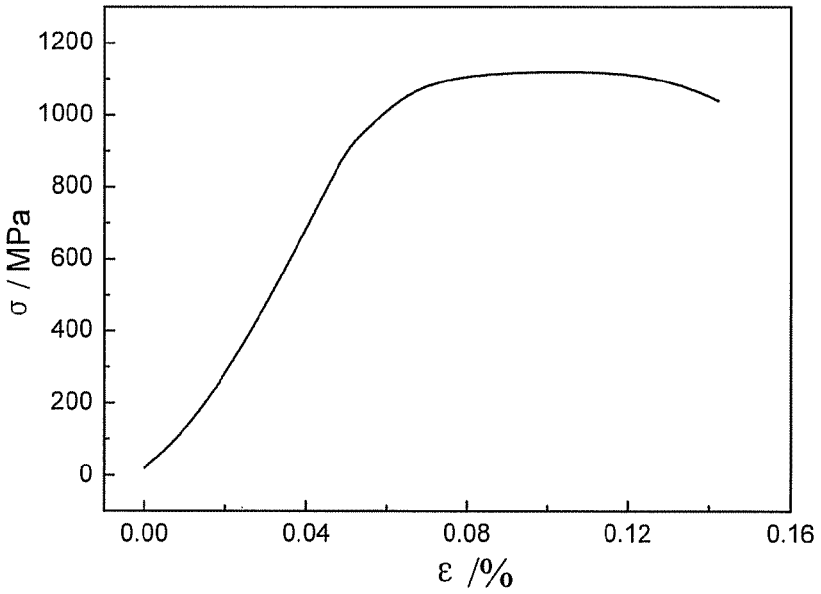
Figure 1 A room temperature tensile stress-strain curve of the Ti-5Fe-3Al-0.02C alloy bar after the 560 °C/1h/AC heat treatment
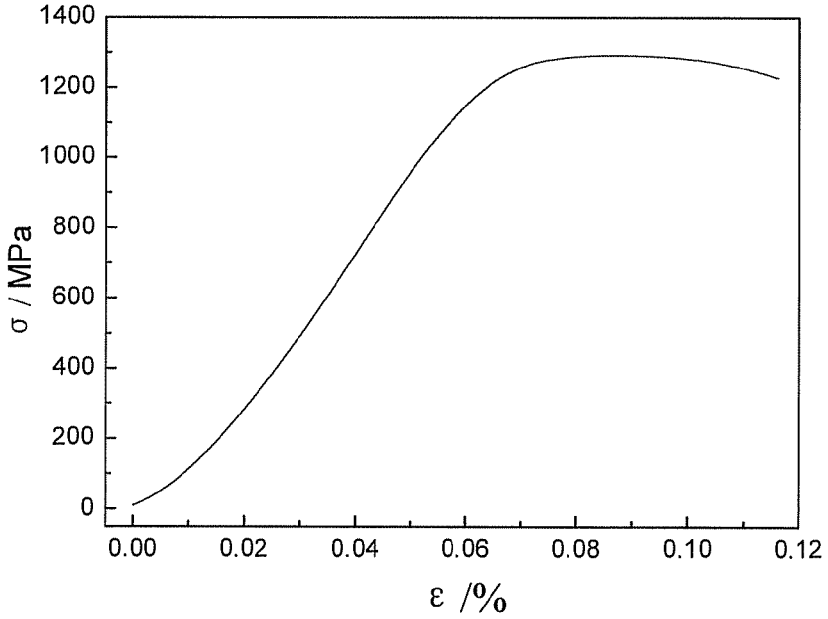
Figure 2 A room temperature tensile stress-strain curve of the Ti-5Fe-3Al-0.02C alloy bar after the 840 °C/40min/WQ+475 °C/4h/AC heat treatment

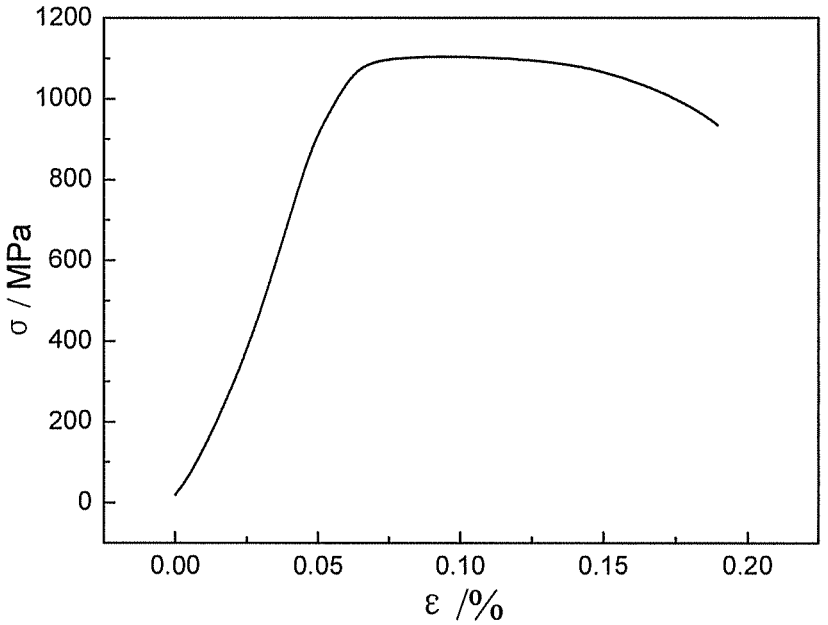
Figure 3 A room temperature tensile stress-strain curve of the Ti-3Fe-5Al-0.01C alloy bar after the 600 °C/1h/AC heat treatment
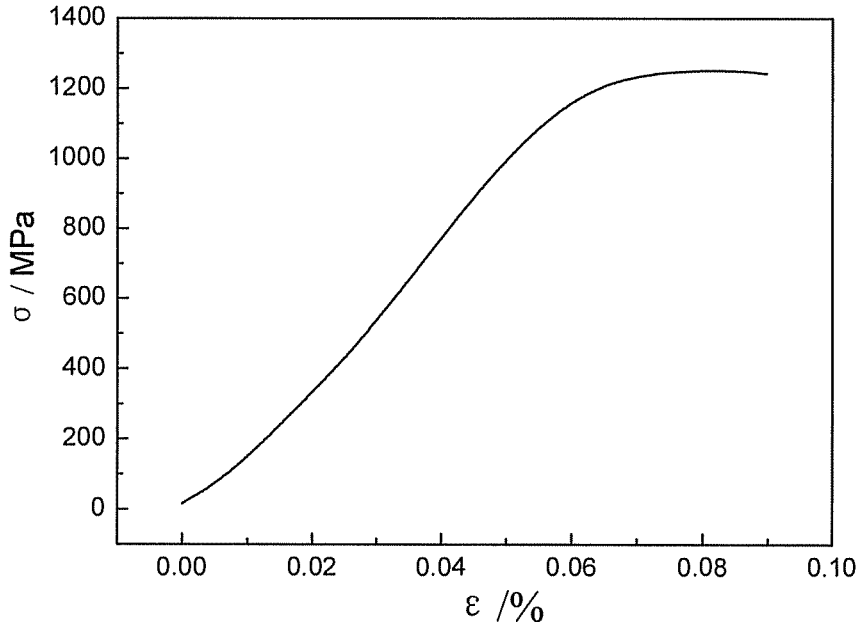
Figure 4 A room temperature tensile stress-strain curve of the Ti-3Fe-5Al-0.01C alloy bar after the 940 °C/40min/WQ+500 °C/4h/AC heat treatment

LOW COST AND HIGH STRENGTH TITANIUM ALLOY AND HEAT TREATMENT PROCESS

CROSS REFERENCE TO RELATED APPLICATIONS

This application is a U.S. National Stage Application of International Application No. PCT/CN2013/073322 filed Mar. 28, 2013, which claims priority from Chinese Patent Application No. 201210343128.9 filed Sep. 14, 2012. The entirety of all the above-listed applications are incorporated herein by reference.

TECHNICAL FIELD

The invention belongs to the technical field of metal alloys, and in particular, refers to a low cost and high strength titanium alloy that iron and aluminum can be used as the main alloying element, and the heat treatment process.

BACKGROUND OF THE INVENTION

The excellent comprehensive properties of the titanium and the titanium alloy can be widely applied in the aerospace field, etc., but as compared to the aluminum alloy and the ferrous materials, the high cost limits the broader use of the titanium alloy, particularly in the civil field, so in order to popularize the application of the titanium alloy, it is necessary to research and develop the low cost titanium alloy and the manufacturing technique thereof. Among the relative higher cost factors in the titanium alloy, the vacuum melting and processing account for 60% of the total cost, the raw materials account for 40% of the total cost, therefore the titanium alloy composition design by using the inexpensive alloy elements may effectively reduce the costs of the titanium alloy.

Among the inexpensive alloy elements, the iron element is one of the most common, the most widely used elements, and the iron element is an excellent β phase stable element among the titanium alloy. Adding a certain amount of the iron into the titanium alloy may lower the phase transformation point, stabilize the β phase, and improve the hot and cold processing property of materials, so Fe is widely used in many titanium alloys. For example, adding 2% (mass %) of the iron into the aerial TB6 alloy may improve the thermoforming property, which is very suitable for the isothermal forging and the super-plastic forming processes.

The Industrial pure iron, the carbon steel and the cast iron may be used as the master alloy to realize that the iron element and the traces of the carbon element are added into the titanium alloy, and adding a certain amount of the aluminum element can further improve the strength of titanium alloy. Our previous experiments also show that a certain amount of the iron element in the titanium alloy has a very good strengthening effect.

SUMMARY OF THE INVENTION

A purpose of the invention is to provide a low cost titanium alloy that the iron and the aluminum can be used as the main alloying element, and the alloy heat treatment process, that is, the temperature and the time for obtaining the optimum comprehensive property of the alloy.

The technical solution is that: alloy elements of the low cost and high strength titanium alloy and the weight percent thereof are as follows: the content of Fe is 3%~7%, the content of Al is 3%~5%, the content of C is 0.01%~0.02%, the balance is Ti, and the unavoidable impurities.

The heat treatment process provided by the invention, characterized in that the heat treatment includes a solid solution treatment and an ageing treatment, and in the solid solution treatment, the temperature is 820~950° C., the time is 60 minutes, water quenching (WQ); in the ageing treatment, the temperature is 450~550° C., the time is 4 hours, air cooling (AC).

The advantage of the invention is that, compared to the commonly used titanium alloy, the alloy does not include the expensive alloy elements of the molybdenum, vanadium etc., which can reduce the raw material costs of the alloy, and the solid solution and ageing heat treatment process of the low cost and high strength alloy is recommended as an effective basis for the element heat treatment design later, which allows the alloy have the excellent comprehensive mechanical properties and have a wide application prospect in the engineering field.

BRIEF DESCRIPTION OF THE DRAWINGS

FIG. 1 is a room temperature tensile stress-strain curve of the Ti—5Fe—3Al—0.02C alloy bar after the 560° C./1 h/AC heat treatment, in which the tensile strength $\sigma_b$=1100 MPa, the elongation δ=13%;

FIG. 2 is a room temperature tensile stress-strain curve of the Ti—5Fe—3Al—0.02C alloy bar after the 840° C./40 min/WQ+475° C./4 h/AC heat treatment, in which the tensile strength $\sigma_b$=1290 MPa, the elongation δ=10%;

FIG. 3 is a room temperature tensile stress-strain curve of the Ti—3Fe—5Al—0.01C alloy bar after the 600° C./1 h/AC heat treatment, in which the tensile strength $\sigma_b$=1100 MPa, the elongation δ=16%;

FIG. 4 is a room temperature tensile stress-strain curve of the Ti—3Fe—5Al—0.01C alloy bar after the 940° C./40 min/WQ+500° C./4 h/AC heat treatment, in which the tensile strength $\sigma_b$=1180 MPa, the elongation δ=8%.

DETAILED DESCRIPTION OF THE EMBODIMENTS

The invention is explained in further detail below, the low cost and high strength titanium alloy is characterized in that, the weight percent composition of the alloy are: the content of Fe is 3%~7%, the content of Al is 3%~5%, the content of C is 0.01~0.02%, the balance is Ti and the unavoidable impurities.

The low cost Ti—Fe—Al—C titanium alloy is manufactured as follows: the titanium sponge grade 0, 99.3% of the industrial pure iron, 99.5% of the industrial pure aluminum, the industrial 45 carbon steel are mixed, which satisfy the composition demand; and then the mixture is pressed to the block with the 200 tons hydraulic machine. The pressed block is double-melted with the 5 KG vacuum suspension induction furnace in which the smelting temperature is 1700° C.~1850° C., so the titanium alloy cast ingot is obtained. The titanium alloy is stripped, removed the head and tail, and flayed, then is painted by the glass protective lubricant; finally the bars and the plates are forged by the cogging forging. The temperature of the cogging heating is between 950° C. and 1050° C., the temperature of the final precision forging is between 800° C. and 900° C.

Example 1

The alloy raw materials are prepared by the nominal composition Ti—5Fe—3Al—0.02C (the weight percentage, %). Titanium sponge grade 0, 99.3% industrial pure iron, 99.5% industrial pure aluminum, and industrial 45 carbon steel are used as the raw materials. The raw materials are mixed and the mixture is pressed to the block with the 200 tons hydraulic machine. The pressed block is double-melted with the 5 KG vacuum suspension induction furnace to acquire the alloy cast ingot. After the stripping process, the cast ingot is painted by the glass protective lubricant to prevent the alloy oxidation at high temperature. The cast ingot is cogging forged in 980° C., subsequently is subjected to multi-pass upsetting and stretching in 850° C. to refine the microstructure, finally the ϕ25 mm bar is forged. After the 560° C./1 h/AC heat treatment, the room temperature tensile properties of the bar are that: the tensile strength $\sigma_b$=1100 MPa, the yield strength $\sigma_{0.2}$=950 MPa, the elongation δ=13% (as illustrated in FIG. 1).

After the solid solution and ageing treatment of 840° C./40 min/water quenching (WQ)+475° C./4 h/air cooling (AC) and 860° C./40 min/WQ+500° C./4 h/AC, the bar obtains the following mechanical properties: the tensile strength $\sigma_b$=1290 MPa, the yield strength $\sigma_{0.2}$=1180 MPa, the elongation δ=10% (as illustrated in FIG. 2).

Example 2

The alloy raw materials are prepared by the nominal composition Ti—3Fe—5Al—0.01C (weight percentage, %). Titanium sponge grade 0, 99.3% industrial pure iron, 99.5% industrial pure aluminum are used as the raw materials. Then the raw materials are mixed and the mixture is pressed to the block with the 200 tons hydraulic machine, the pressed block is double-melted with the 5 KG vacuum suspension induction furnace to acquire the alloy cast ingot. After the stripping process, the cast ingot is painted by the glass protective lubricant to prevent the alloy high temperature oxidation. The cast ingot is cogging forged in 980° C., subsequently are subjected to multi-pass upsetting and stretching in 850° C. to refine the microstructure, finally the ϕ25 mm bar is forged. After the 600° C./1 h/AC heat treatment, the room temperature tensile properties of the bar are that: the tensile strength $\sigma_b$=1180 MPa, the yield strength $\sigma_{0.2}$=950 MPa, the elongation δ=16% (as illustrated in FIG. 3).

After the solid solution and ageing treatment of 940° C./40 min/WQ+500° C./4 h/AC and 900° C./40 min/WQ+500° C./4 h/AC, the bar obtains the mechanical properties, in which the tensile strength $\sigma_b$=1180 MPa, the yield strength $\sigma_{0.2}$=980 MPa, the elongation δ=8% (as illustrated in FIG. 4).

the nominal compositions in Example 3~Example 6 refer to table 1.

Table 1 the alloy nominal compositions in Example 3~Example 6

Fe: 2%~7%; Al: 3%~5%; C: 0.01%~0.02%; the balance is Ti, and the unavoidable impurities.

| Example | Composition of the alloy (wt. %) | | | |
|---|---|---|---|---|
| number | Fe | Al | C | Ti |
| 3 | 3 | 3 | 0.01 | balance |
| 4 | 5 | 5 | 0.01 | balance |
| 5 | 7 | 3 | 0.02 | balance |
| 6 | 7 | 5 | 0.02 | balance |

The alloy manufacturing processes in the above examples are similar to the example 1 and example 2, the alloy in example 3~6 is forged to the Φ15 mm bar, after the 500° C.~650° C./1 h/AC heat treatment, the obtained mechanical property typical values are that: the tensile strength ≥ 900 MPa, the yield strength ≥ 830 MPa, the elongation ≥ 9%.

After the (820° C.~950° C.)/1 hANQ+(450° C.~550° C.)/4 h/AC heat treatment, the obtained mechanical property typical values of the alloy in Example 3~6 are that: the tensile strength ≥ 1000 MPa, the yield strength ≥ 900 MPa, the elongation ≥ 6%.

What is claimed is:

1. A method of producing a high strength titanium alloy, the method comprising:

providing an alloy comprising Ti, Fe, Al, and C, wherein weight percentage of elements in the alloy are: content of Fe is 3%-7%, content of Al is 3%-5%, content of C is 0.01%-0.02%, with a balance being Ti, and impurities;

providing a first solid solution treatment to the alloy at a temperature of 940° C., for a period of 40 minutes, followed by water quenching;

providing an first ageing treatment to the alloy at a temperature of 500° C., for 4 hours, followed by air cooling;

providing a second solid solution treatment to the alloy at a temperature of 900° C., for a period of 40 minutes, followed by water quenching; and providing a second ageing treatment at a temperature of 500° C., for 4 hours, followed by air cooling; and wherein the alloy has a tensile strength of at least 1180 MPa, a yield strength of at least 980 MPa, and an elongation of at least 8%.

2. The method of claim 1, wherein the alloy is comprised of titanium of sponge/base grade 0, iron of 99.3% industrial purity, aluminum of 99.5% industrial purity, and carbon of industrial 45 grade.

3. The method of claim 2, wherein the alloy has a tensile strength of at least 1290 MPa, a yield strength of at least 1180 MPa, and an elongation of at least 10%.

4. The method of claim 1, further comprising:

prior to providing the solid solution treatment, pressing the alloy to a block with a 200 ton hydraulic machine.

5. The method of claim 4, further comprising:

double-melting the pressed block with a 5 kilogram vacuum suspension induction furnace using a smelting temperature between 1700° C. and 1850° C. to provide a cast ingot of the alloy.

6. The method of claim 1, further comprising:

prior to the providing a solid solution treatment, forging bars and/or plates of the alloy via cogging forging including an initial cogging heating at a temperature between 950° C. and 1050° C., followed by a final precision forging at a temperature between 800° C. and 900° C.

7. The method of claim 6 wherein the initial cogging heating is performed at a temperature of 980° C., and wherein the final precision forging includes multi-pass upsetting and stretching processes at a temperature of 850° C.

8. The method of claim 1 wherein, prior to the providing a solid solution treatment, the alloy is forged into a ϕ25 mm bar, and wherein, as a result of the forging, the alloy has a tensile strength of at least 1100 MPa, a yield strength of at least 950 MPa, and an elongation of at least 13%.

9. The method of claim 1 wherein the alloy has a tensile strength of at least 1290 MPa, a yield strength of at least 1180 MPa, and an elongation of at least 10%.

10. The method of claim 1 wherein the weight percentage content of Fe is 3%, the weight percentage of Al is 5%, and the weight percentage of C is 0.01%, and wherein the alloy has an elongation of at least 16%.

11. The method of claim 1 wherein the alloy is created from an ingot that received a heat treatment at a temperature of between 500° C. and 650° C., for a period of 1 hour, wherein the alloy has an elongation of at least 9%.

12. The method of claim 1 wherein the weight percentage content of Fe is 3%, the weight percentage of Al is 3%, and the weight percentage of C is 0.01%, and wherein the alloy has an elongation of at least 9%.

13. The method of claim 1 wherein the weight percentage content of Fe is 5%, the weight percentage of Al is 3%, and the weight percentage of C is 0.01%, and wherein the alloy has an elongation of at least 9%.

14. The method of claim 1 wherein the weight percentage content of Fe is 7%, the weight percentage of Al is 3%, and the weight percentage of C is 0.02%, and wherein the alloy has an elongation of at least 9%.

15. The method of claim 1 wherein the weight percentage content of Fe is 7%, the weight percentage of Al is 5%, and the weight percentage of C is 0.02%, and wherein the alloy has an elongation of at least 9%.

16. The method of claim 1 wherein the weight percentage content of Fe is 5%, the weight percentage of Al is 3%, and the weight percentage of C is 0.01%, and wherein the alloy has an elongation of at least 9%.

17. The method of claim 1 wherein the weight percentage content of Fe is 7%, the weight percentage of Al is 3%, and the weight percentage of C is 0.02%, and wherein the alloy has an elongation of at least 9%.

18. The method of claim 1 wherein the weight percentage content of Fe is 7%, the weight percentage of Al is 5%, and the weight percentage of C is 0.02%, and wherein the alloy has an elongation of at least 9%.

19. The method of claim 1 wherein the alloy has an elongation of at least 9%.

20. The method of claim 1 wherein the alloy has an elongation of at least 10%.

* * * * *